US006679220B2

(12) United States Patent
Shiraishi et al.

(10) Patent No.: US 6,679,220 B2
(45) Date of Patent: Jan. 20, 2004

(54) MULTI-CYLINDER ENGINE

(75) Inventors: Yasunori Shiraishi, Sakai (JP); Masahiro Aketa, Sakai (JP); Wataru Iwanaga, Sakai (JP); Makoto Watanabe, Sakai (JP)

(73) Assignee: Kubota Corporation (JP)

( * ) Notice: Subject to any disclaimer, the term of this patent is extended or adjusted under 35 U.S.C. 154(b) by 45 days.

(21) Appl. No.: 10/100,137

(22) Filed: Mar. 19, 2002

(65) Prior Publication Data

US 2003/0062016 A1 Apr. 3, 2003

(30) Foreign Application Priority Data

Sep. 28, 2001 (JP) ..... P 2001-299507

(51) Int. Cl.[7] ..... F02F 7/00
(52) U.S. Cl. ..... 123/195 R
(58) Field of Search ..... 123/195 R, 193.1, 123/41.72, 41.74, 41.79

(56) References Cited

U.S. PATENT DOCUMENTS

| | | | | |
|---|---|---|---|---|
| 3,094,190 A | | 6/1963 | Conover et al. | |
| 4,345,552 A | | 8/1982 | Kasting et al. | |
| 5,452,691 A | * | 9/1995 | Nilsson et al. | 123/195 R |
| 5,460,140 A | * | 10/1995 | Porter | 123/195 R |
| 5,474,040 A | * | 12/1995 | Murakami et al. | 123/195 R |
| 5,664,538 A | * | 9/1997 | Hutchins | 123/195 R |
| 5,727,512 A | * | 3/1998 | Hutchins | 123/195 R |
| 5,758,608 A | | 6/1998 | Berger et al. | |
| 5,842,447 A | * | 12/1998 | Krotky et al. | 123/195 R |
| 5,868,107 A | * | 2/1999 | Betsch et al. | 123/195 R |
| 6,082,320 A | * | 7/2000 | Shimayama | 123/195 R |
| 6,101,994 A | * | 8/2000 | Ichikawa | 123/195 R |
| 6,125,811 A | * | 10/2000 | Koriyama et al. | 123/195 R |
| 6,135,081 A | * | 10/2000 | Eidenboeck et al. | 123/195 R |
| 6,253,725 B1 | * | 7/2001 | Groddeck et al. | 123/195 R |
| 6,283,081 B1 | | 9/2001 | Ozeki | |

FOREIGN PATENT DOCUMENTS

| | | |
|---|---|---|
| DE | 433558 | 9/1926 |
| EP | 0837235 | 4/1998 |

* cited by examiner

*Primary Examiner*—Henry C. Yuen
*Assistant Examiner*—Jason Benton
(74) *Attorney, Agent, or Firm*—Bacon & Thomas, PLLC

(57) ABSTRACT

In a multi-cylinder engine, an inner space (17) is interposed between upper and lower female screws (9), (13) and an outer wall (14) of a cylinder block (6). Lower peripheral wall portions (15), (15) of a cylinder wall (1) continue with left and right both sides (2*c*), (2*c*) of a lower side portion (2*b*) of an inter-cylinder wall (2) in a front and rear direction and increase their thicknesses progressively as they approach the left and right both sides (2*c*), (2*c*).

6 Claims, 6 Drawing Sheets

MULTI-CYLINDER ENGINE

BACKGROUND OF THE INVENTION

1. Field of the Invention

The present invention relates to a multi-cylinder engine.

2. Description of Prior Art

There is the following engine as a conventional example of the multi-cylinder engine.

An inter-cylinder wall has an upper side portion provided on its left and right both sides with inter-cylinder bosses. The inter-cylinder bosses are connected to left and right both sides of a lower side portion of the inter-cylinder wall in continuity therewith. An upper female screw is provided in one of the inter-cylinder bosses. A head bolt engages with the upper female screw in screw-thread attachment. A bearing wall of a crank shaft is formed so that it can be divided into an upper wall portion and a lower wall portion. The upper wall portion is connected to a cylinder block and has left and right both sides provided with upper wall bosses. These upper wall bosses have upper end portions connected to the left and right both sides of the lower side portion of the inter-cylinder wall in continuity therewith. A lower female screw is provided in one of the upper wall bosses. A bearing bolt engages with the lower female screw in screw-thread attachment to assemble the lower wall portion to the cylinder block.

As for this type of engine, a gas pressure produced in a combustion chamber raises up a cylinder head and lowers the lower wall portion. This results in raising the upper female screw by the head bolt and lowering the lower female screw through the bearing bolt.

However, this type of engine generally has the upper female screw and the lower female screw formed in an outer wall of the cylinder block.

The foregoing conventional technique has the following problems.

"Problem 1"

The Outer Wall of the Cylinder Block Readily Vibrates

The upper female screw and the lower female screw are formed in the outer wall of the cylinder block. Therefore, the outer wall of the cylinder block extends and easily vibrates with the gas pressure produced in the combustion chamber. This enlarges the engine's noise and shortens its useful life.

In order to solve the problem 1, like the present invention, it is effective to interpose an inner space 17 between the upper and lower female screws 9, 13 and the outer wall 14 of the cylinder block 16 as shown in FIG. 1. However, in this case, the gas pressure with which the outer wall 14 of the cylinder block 6 is burdened acts on the left and right both sides 2*c*, 2*c* of the lower side portion 2*b* of the inter-cylinder wall 2 as well as on lower left and right peripheral wall portions 15, 15 of a cylinder wall 1 in continuity with them in the front and rear direction. Therefore, in the event each of these portions has a reduced thickness, there is a likelihood that the following new problem will occur.

"Problem 2"

The Lower Left and Right Peripheral Wall Portions of the Cylinder Wall Undergo a Large Strain In the case where the lower left and right peripheral wall portions of the cylinder wall each has a reduced thickness, this portion undergoes a large strain to result in seizing a piston and producing a slap sound or the like.

SUMMARY OF THE INVENTION

The present invention has an object to provide a multi-cylinder engine capable of solving the above-mentioned problems.

A principal construction of the present invention is as follows.

As shown in FIG. 1, the inner space 17 is interposed between the upper and lower female screws 9, 13, which engage with the head bolt 8 and the bearing bold 12 in screw-thread attachment, respectively, and the outer wall 14 of the cylinder block 6.

As shown in FIGS. 3 and 4, the lower left and right peripheral wall portions 15, 15 of the cylinder wall 1 continue with the left and right both sides 2*c*, 2*c* of the lower side portion 2*b* of the inter-cylinder wall 2 in the front and rear direction. They increase their thicknesses progressively as they approach the left and right both sides 2*c*, 2*c*.

The present invention offers the following effect.

"Effect 1"

The Outer Wall of the Cylinder Block Hardly Vibrates

As shown in FIG. 1, the inner space 17 is interposed between the upper and lower female screws 9, 13 and the outer wall 14 of the cylinder block 6. The gas pressure produced in the combustion chamber hardly extends and vibrates the outer wall 14 of the cylinder block 6. This decreases the engine's noise and also elongates its useful life.

"Effect 2"

It is Possible to Inhibit the Strain of the Lower Left and Right Peripheral Wall Portions of the Cylinder Wall As shown in FIGS. 3 and 4, the lower left and right peripheral wall portions 15, 15 of the cylinder wall 1 continue with the left and right both sides 2*c*, 2*c* of the lower side portion 2*b* of the inter-cylinder wall 2 and increase their thicknesses gradually as they approach the left and right both sides 2*c*, 2*c*. Therefore, even if a large gas pressure acts on the lower left and right peripheral wall portions 15, 15 of the cylinder wall 1, it is possible to inhibit the strain of these portions with the result of prohibiting the seizure of the piston and the production of the slap sound or the like attributable to the strain of these portions.

"Effect 3"

It is Possible to Secure a Strength of the Lower Side Portion of the Inter-cylinder Wall As shown in FIG. 1, a lowermost edge 20 of a transverse water passage 18 is arranged higher than a position 19 of a piston ring at the uppermost portion of a piston head positioned at a bottom dead center. This arrangement makes it possible to secure a full height of the lower side portion 2*b* of the inter-cylinder wall 2 and therefore surely obtain a strength of this portion.

"Effect 4"

It is Possible to Inhibit a Shear Strain of the Lower Side Portion of the Inter-cylinder Wall As shown in FIG. 1, a pair of the vertically positioned head bolt 8 and bearing bolt 12 are arranged on the same axis 29. This arrangement enables a pulling force the lower side portion of the inter-cylinder wall 2 receives to act on the same axis 29, which results in the possibility of inhibiting a shear strain of the lower side portion 2*b* of the inter-cylinder wall 2. This can prevent the seizure of the piston and the production of the slap sound or the like attributable to the shear strain of this portion.

"Effect 5"

Parts' Control is Facilitated and at the Same Time Parts' Cost is Reduced

As shown in FIG. 1, the head bolt 8 is made common with the bearing bolt 12. This facilitates the control of bolts and reducing the cost for purchasing the bolts.

"Effect 6"

It is Possible to Effectively Utilize the Lower Side Portion of the Inter-cylinder Wall As shown in FIG. 1, an oil supply passage 21 is made to pass a space defined between the upper female screw 9 and the lower female screw 13. Owing to this arrangement, the lower side portion 2*b* of the inter-cylinder wall 2 can be effectively utilized as a wall for forming the oil supply passage 21.

"Effect 7"

Chips Produced when Working Screws can be Inhibited from Entering the Oil Supply Passage As shown in FIG. 1, the oil supply passage 21 does not communicate with either of the upper female screw 9 and the lower female screw 13. This arrangement results in being able to inhibit the chips produced when working screws, from entering the oil supply passage 21.

"Effect 8"

It is Possible to Effectively Utilize the Lower Side Portion of the Inter-cylinder Wall As shown in FIG. 1, a hole 23 of an interlocking shaft 22 invades the lower side portion 2*b* of the inter-cylinder wall 2 between the upper female screw 9 and the lower female screw 13. Owing to this arrangement, the lower side portion 2*b* of the inter-cylinder wall 2 can be effectively utilized for forming the hole 23.

"Effect 9"

It is Possible to Produce Different Types of Engines Separately with Ease

As shown in FIG. 1, the cylinder block 6 can be divided into an upper block portion 6*a* and a lower block portion 6*b*. Owing to this arrangement, it is possible to produce different types of engines separately with ease by preparing a plurality of lower block portions 6*b* and assembling these lower block portions 6*b* selectively to the upper block portion 6*a*. For example, a lower block portion 6*b* large in width for standard use and another lower block portion 6*b* small in width for tractor use are prepared. If these lower block portions 6*b* are selectively assembled to the upper block portion 6*a*, it is possible to produce an engine for standard use and another engine for tractor use separately with ease.

"Effect 10"

It is Possible to Reduce a Burden Applied on the Left and Right Both Sides of the Lower Side Portion of the Inter-cylinder Wall As shown in FIG. 6, the bearing wall 10 has the lower wall portion 10*b* connected to the lower block portion 6*b*. In this arrangement, the gas pressure produced in the combustion chamber is burdened not only by the left and right both sides of the lower side portion 2*b* of the inter-cylinder wall 2 but also by the upper block portion 6*a* through the lower block portion 6*b*. This can reduce the burden applied on the left and right both sides of the lower side portion 2*b* of the inter-cylinder wall 2.

"Effect 11"

Butting Surfaces of the Upper and Lower Block Portions Exert a High Sealing Force As shown in FIG. 6, the bearing wall 10 has its lower wall portion 10*b* connected to the lower block portion 6*b*. In this arrangement, the butting surfaces of the upper and lower block portions 6*a* and 6*b* are sealed through both of block assembling bolts 24 and the bearing bolts 12 to result in exerting a high sealing force.

"Effect 12"

The Cylinder Block has a High Rigidity

As shown in FIGS. 4 and 5, the cylinder block 6 has its left and right outer walls 14 curved along external outlines of a connecting rod 25 and a crank arm 26 which pass the vicinity of the left and right outer walls 14. This arrangement affords a high rigidity of the cylinder block 6.

"Effect 13"

The Sealing Force Exerted by the Butting Surfaces of the Upper and Lower Block Portions is Strengthened As shown in FIGS. 4 and 5, attaching bosses 28*a* and 28*b* of the block assembling bolts 24, 24 are formed in an inner side wall portion 27 which is retreated inwards. The left and right attaching bosses 28*a* and 28*b* mutually approach to strengthen the sealing force exerted by the butting surfaces of the upper and lower block portions 6*a* and 6*b*.

"Effect 14"

It is Possible to Take a Sufficient Thickness of Each of the Left and Right Peripheral Wall Portions of the Cylinder Wall Near the Inter-cylinder Wall As shown in FIG. 4, the lower left and right peripheral wall portions 15, 15 of the cylinder wall 1 are arranged so that they start to increase their thicknesses from their mid portions 15*a*, 15*a* in the front and rear direction. This arrangement makes it possible to take a sufficient thickness of each of the left and right peripheral wall portions 15, 15 of the cylinder wall 1 near the inter-cylinder wall 2.

"Effect 15"

It is Possible to Take a Sufficient Thickness of Each of the Left and Right Peripheral Wall Portions of the Cylinder Wall Near the Inter-cylinder Wall As shown in FIG. 4, both of outwardly facing surfaces 15*b*, 15*b* of the left and right peripheral wall portions 15, 15 are arranged to externally flare toward the left and right both sides 2*c*, 2*c* from their mid portions 15*a*, 15*a* in the front and rear direction. This arrangement makes it possible to take a sufficient thickness of each of the left and right peripheral wall portions 15, 15 of the cylinder wall 1 near the inter-cylinder wall 2.

"Effect 16"

It is Possible to Take a Sufficient Thickness of the Left and Right Peripheral Wall Portions of the Cylinder Wall near the Inter-cylinder Wall and besides Facilitate the Molding of the Cylinder Wall In the case where both of the outwardly facing surfaces 15*b*, 15*b* of the lower left and right peripheral wall portions 15, 15 of the cylinder wall 1 are formed substantially straight as a whole along the front and rear direction, it is possible to take a sufficient thickness of each of the left and right peripheral wall portions 15, 15 of the cylinder wall 1 near the inter-cylinder wall 2 and besides facilitate the molding of the cylinder wall 1.

DESCRIPTION OF THE PREFERRED EMBODIMENTS

An embodiment of the present invention is explained based on the drawings. FIGS. 1 to 6 show the embodiment of the present invention. In this embodiment, explanation is given for a vertical water-cooled series multi-cylinder diesel engine.

This engine is constructed as follows.

Figure 6:
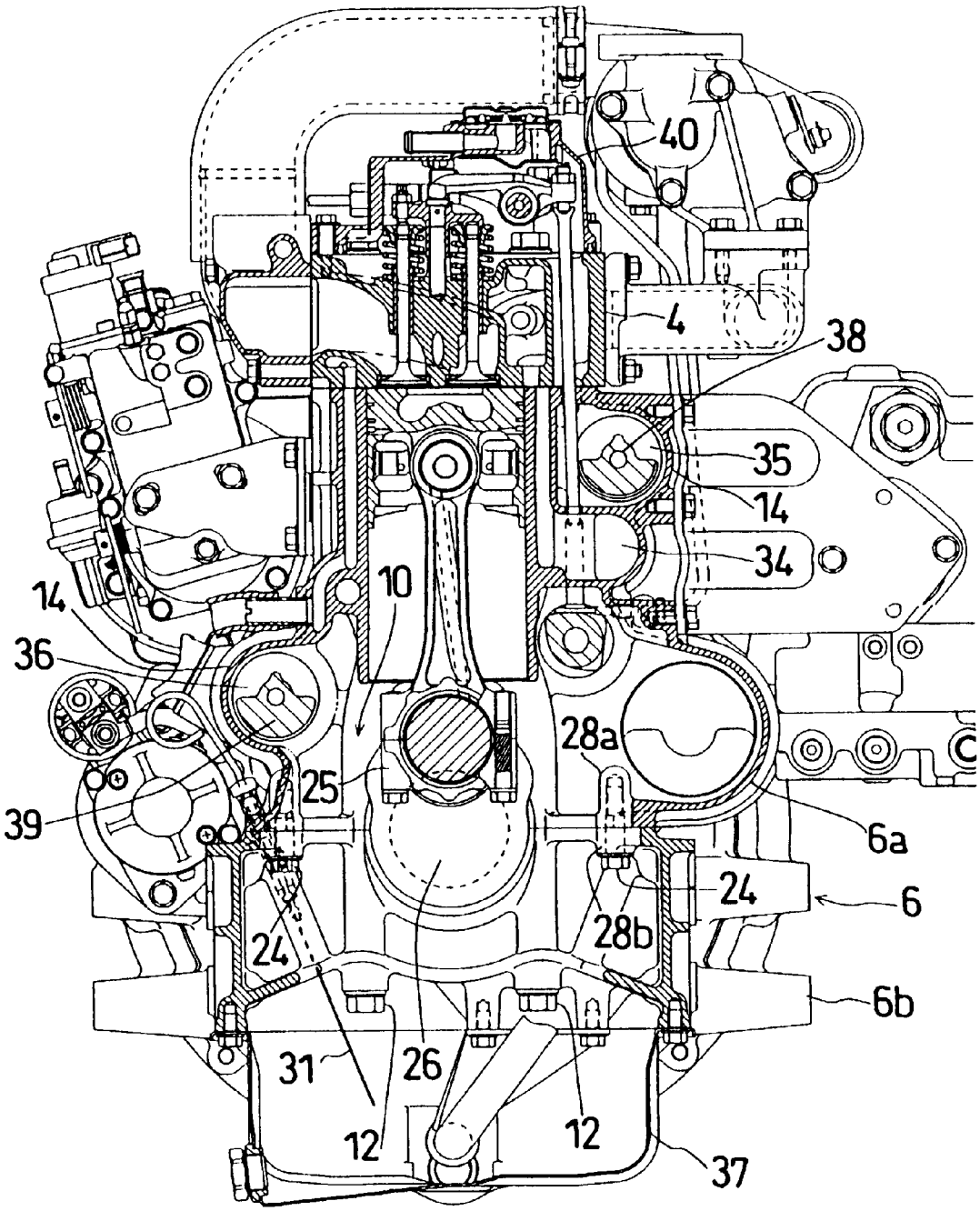
FIG. 6 is a vertical sectional front view of the engine according to the embodiment of the present invention.

As shown in FIG. 6, a cylinder head 4 is assembled to an upper portion of a cylinder block 6. A head cover 40 is assembled to an upper portion of the cylinder head 4. An oil pan 37 is assembled to a lower portion of the cylinder block 6.

The cylinder head 4 is assembled in the following manner.

Figure 1:
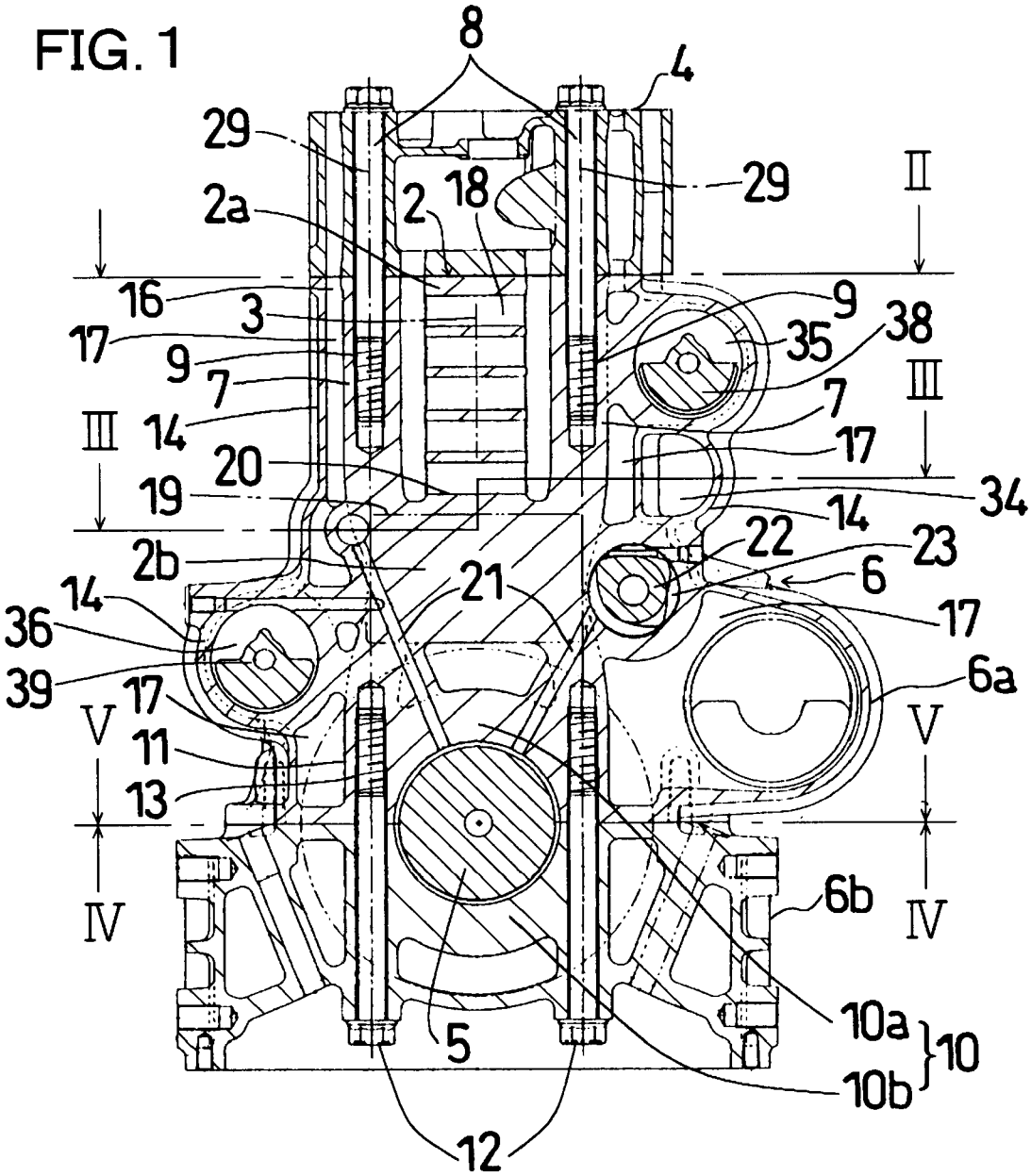
FIG. 1 is a vertical sectional front view of a cylinder head of a cylinder block of an engine according to an embodiment of the present invention.
Figure 2:
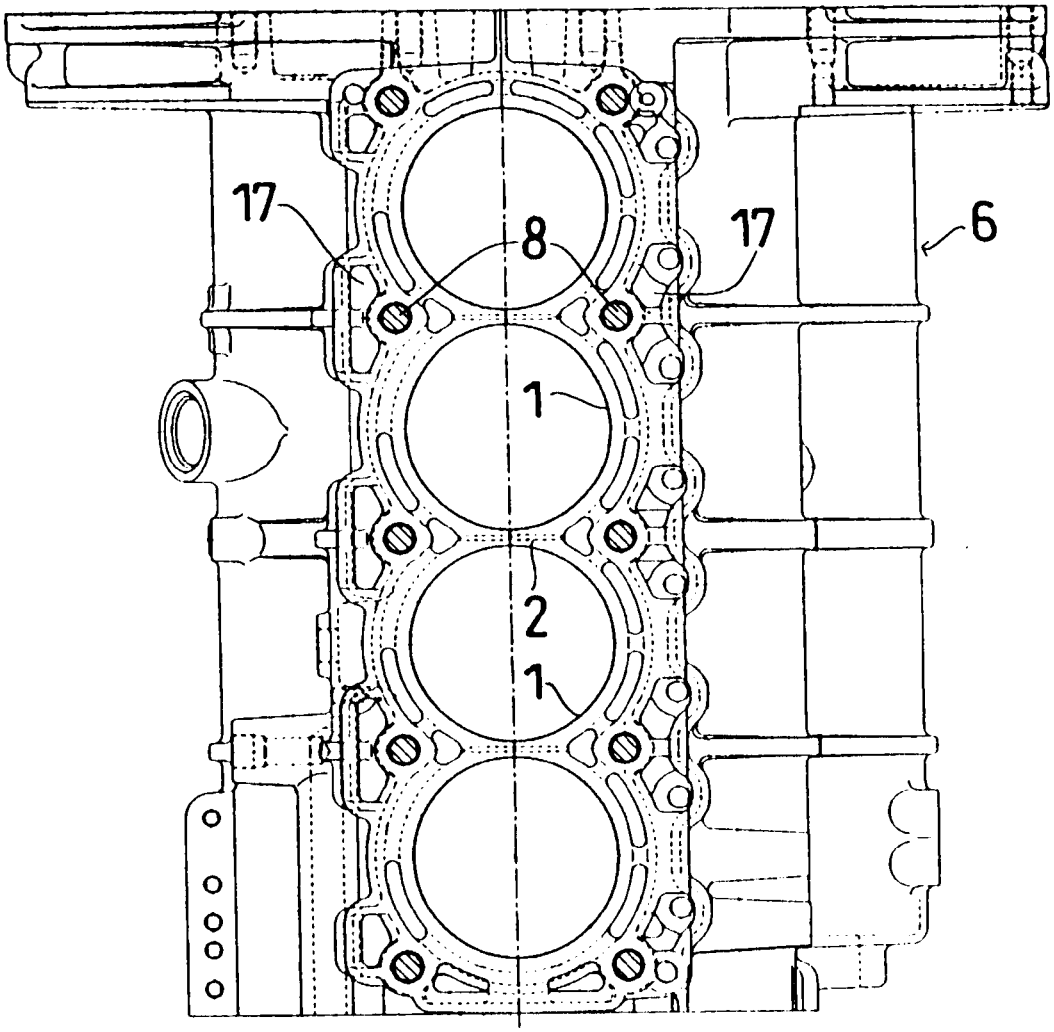
FIG. 2 is a plan view of the cylinder block of the engine according to the embodiment of the present invention.

As shown in FIG. 2, adjacent cylinder walls 1, 1 are mutually connected to form an inter-cylinder wall 2. As shown in FIG. 1, when assuming a direction of a cylinder center axis 3 as a vertical direction, a side on which the cylinder head 4 is situated as an upper side, a width direction of the cylinder block 6 as a left and right direction, and a spanning direction of a crank shaft 5 as a front and rear direction, inter-cylinder bosses 7, 7 are provided on left and right both side of an upper side portion 2*a* of the inter-cylinder wall 2. The inter-cylinder bosses 7, 7 have lower portions connected in continuity with upper portions of left and right both sides 2*c*, 2*c* of a lower side portion 2*b* of the inter-cylinder wall 2.

As shown in FIG. 1, a head bolt 8 extends through the cylinder head 4 and is inserted into one of the inter-cylinder bosses 7, 7. An upper female screw 9 is provided in the inter-cylinder boss 7. The head bolt 8 engages with the upper female screw 9 in screw-thread attachment so as to assemble the cylinder head 4 to the cylinder block 6. The upper female screw 9 may be formed in one or both of the inter-cylinder boss 7 and the lower side portion 2*b* of the inter-cylinder wall 2.

The cylinder block 6 is assembled in the following manner.

As shown in FIG. 1, the cylinder block 6 has a crank case within which a bearing wall 10 for the crank shaft 5 is formed. This bearing wall 10 is made so that it can be divided into an upper wall portion 10*a* and a lower wall portion 10*b*. The upper wall portion 10*a* is connected to the cylinder block 6 and is provided on its left and right both sides with upper wall bosses 11, 11. The upper wall bosses 11, 11 have upper portions connected to lower portions of the left and right both sides 2*c*, 2*c* of the lower side portion 2*b* of the inter-cylinder wall 2 in continuity therewith. A bearing bolt 12 extends through the lower wall portion 10*a* and is inserted into one of the upper wall bosses 11, 11. The upper wall boss 11 is provided with a lower female screw 13. The lower female screw 13 engages with the bearing bolt 12 in screw-thread attachment to assemble the lower wall portion 10*b* to the cylinder block 6. The lower female screw 13 may be formed in one or both of the upper wall boss 11 and the lower side portion 2*b* of the inter-cylinder wall 2.

A device concerning the cylinder block 6 is as follows.

As shown in FIGS. 1 and 2, an inner space 17 is interposed between the upper and lower female screws 9, 13 and an outer wall 14 of the cylinder block 6. Therefore, a gas pressure produced in a combustion chamber hardly extends and vibrates the outer wall 14 of the cylinder block 6. This results in decreasing the engine's noise and elongating its useful life. The cylinder wall 1 has lower left and right peripheral wall portions 15, 15 continued with the left and right both sides 2*c*, 2*c* of the lower side portion 2*b* of the inter-cylinder wall 2 in the front and rear direction. The lower left and right peripheral wall portions 15, 15 of the cylinder wall 1 increase their thicknesses progressively as they approach the left and right both sides 2*c*, 2*c*. Thus, even if a large gas pressure acts on the lower left and right peripheral wall portions 15, 15 of the cylinder wall 1, it is possible to inhibit these portions from undergoing a strain. This results in being able to prohibit the seizure of a piston and the production of slap sound or the like attributable to the strain of these portions. The inner space 17 serves as a space for dropping oil and as a chamber for accommodating a push rod.

The lower left and right peripheral wall portions 15, 15 of the cylinder wall 1 are arranged to increase their thicknesses from their mid portions 15*a*, 15*a* in the front and rear direction. They are connected to the left and right both sides 2*c*, 2*c* of the lower side portion 2*b* of the inter-cylinder wall 2 in the front and rear direction, and have outwardly facing surfaces 15*b*, 15*b*. Both of the outwardly facing surfaces 15*b*, 15*b* externally flare from the mid portions 15*a*, 15*a* in the front and rear direction toward the left and right both sides 2*c*, 2*c*. However, these surfaces externally flare to a slight degree. When the cylinder block 6 is seen just from below, both of the outwardly facing surfaces 15*b*, 15*b* can be said to be formed substantially straight as a whole along the front and rear direction. This makes it possible to take a sufficient thickness of each of the left and right peripheral wall portions 15, 15 near the inter-cylinder wall 2 and besides facilitate the molding of the cylinder wall 1.

Generally, the mid portions 15*a*, 15*a* in the front and rear direction of the left and right peripheral wall portions 15, 15 mean areas each of which is positioned at an equal distance (D) from a pair of adjacent inter-cylinder walls, 2, 2. On assumption that the pair of inter-cylinder walls 2, 2 have centers spaced apart from each other at a distance (D), each of the areas is said to have a dimension (d) of ⅓ of the distance (D). From the viewpoint of securing a sufficient thickness of each of the left and right peripheral wall portions 15, 15 near the inter-cylinder wall 2, the left and right peripheral wall portions 15, 15 starts to increase their thicknesses from the mid portions 15*a*, 15*a* in the front and rear direction. Particularly, it is preferable to start the increase from each of the areas which is positioned at an equal distance from a pair of adjacent inter-cylinder walls 2, 2 and has a dimension of less than ¼ of the distance (D). More preferably, from each of the areas which has a dimension of less than ⅙ of the distance (D) and most preferably, from each of the areas which has a dimension of less than ⅛ of the distance (D). As shown in FIG. 1, a transverse water passage 18 is formed in the inter-cylinder wall 2 so that its lowermost edge 20 is arranged higher than a position 19 of a piston ring at the uppermost portion of a piston head positioned at a bottom dead center. This can secure a full height of the lower side portion 2*b* of the inter-cylinder wall 2 to result in surely obtaining the strength of this portion.

As shown in FIG. 1, a pair of the vertically positioned head bolt 8 and bearing bolt 12 are arranged on the same axis 29. This enables a pulling force the lower side portion 2*b* of the inter-cylinder wall 2 receives to act on the same axis 29, which results in the possibility of inhibiting the lower side portion 2*b* of the inter-cylinder wall 2 from experiencing a shear strain. This can prohibit the seizure of the piston and the production of the slap sound or the like attributable to the shear strain of this portion. Further, the head bolt 8 is made common with the bearing bolt 12. This facilitates the bolts' control and reduces the cost for purchasing the bolts.

As shown in FIG. 1, an oil supply passage 21 is formed in the lower side portion 2*b* of the inter-cylinder wall 2 so that it passes a space defined between the upper female screw 9 and the lower female screw 13 without communicating with them. This can effectively utilize the lower side portion 2*b* of the inter-cylinder wall 2 as a wall for forming the oil supply passage 21 and besides can inhibit the invasion of chips produced when working screws, into the oil supply passage 21. In addition, a hole 23 of an interlocking shaft 22 invades the lower side portion 2*b* of the inter-cylinder wall 2 between the upper female screw 9 and the lower female screw 13. This can effectively utilize the lower side portion 2*b* of the inter-cylinder wall 2 as a wall for forming the hole 23. This interlocking shaft 22 is a valve operating cam shaft.

As shown in FIG. 1, the cylinder block 6 is made so that it can be divided into an upper block portion 6*a* and a lower block portion 6*b*. The lower block portion 6*b* can be assembled to the upper block portion 6*a* through block assembling bolts 24. Accordingly, it is possible to separately produce different types of engines with ease by preparing a plurality of lower block portions 6*b* and assembling them selectively to the upper block portion 6*a*. For example, a lower block portion 6*b* large in width for standard use and another block portion 6*b* small in width for tractor use are prepared. These lower block portions 6*b* are assembled to the upper block portion 6*a* selectively to result in the possibility of separately producing an engine for standard use and another engine for tractor use with ease.

As shown in FIG. 1, the bearing wall 10 has the lower wall portion 10*b* connected to the lower block portion 6*b*. Thus a gas pressure produced in a combustion chamber is burdened not only by the left and right both sides 2*c*, 2*c* of the lower side portion 2*b* of the inter-cylinder wall 2 but also by the upper block portion 6*a* through the lower block portion 6*b*. This can reduce a burden applied on the left and right both sides 2*c*, 2*c* of the lower side portion 2*b* of the inter-cylinder wall 2. In addition, butting surfaces of the upper and lower block portions 6*a* and 6*b* are sealed by both of the block assembling bolts 24 and the bearing bolts 12 with the result of exerting a high sealing force.

Figure 4:
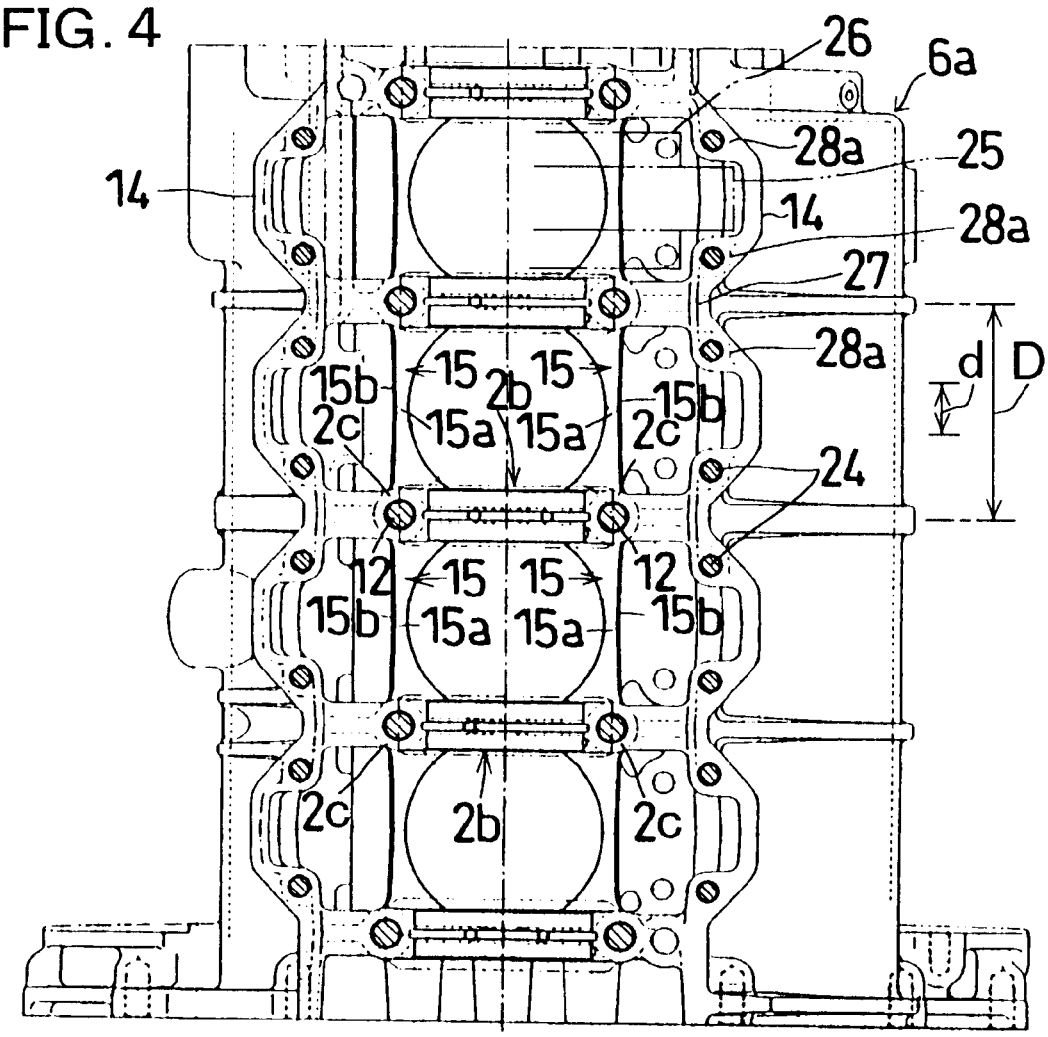
FIG. 4 is a sectional view of FIG. 1 taken along a line VI—VI.
Figure 5:
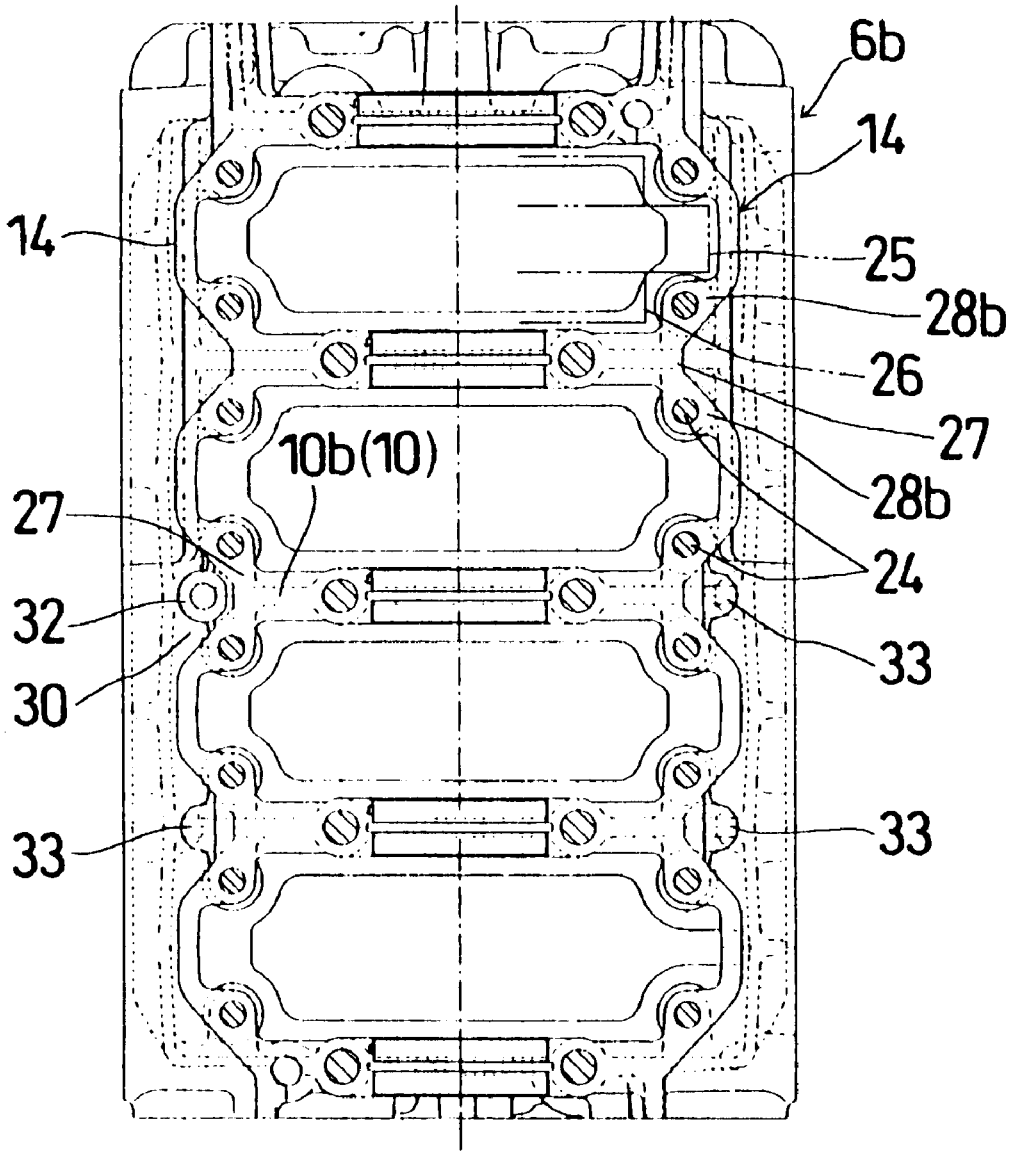
FIG. 5 is a sectional view of FIG. 1 taken along a line V—V.

As shown in FIGS. 4 and 5, the cylinder block 6 has its left and right outer walls 14 curved along external outlines of a connecting rod 25 and a crank arm 26 which pass the vicinity of the left and right outer walls 14 to result in affording a high rigidity. Each of the left and right outer walls 14 has an inner side portion 27 which is retreated inwards. Formed in this inner side wall portion 27 are upper and lower attaching bosses 28*a* and 28*b* for the block assembling bolts 24. Therefore, the left and right attaching bosses 28*a* and 28*b* mutually approach to result in strengthening the sealing force exerted by the butting surfaces of the upper and lower block portions 6*a* and 6*b*.

As shown in FIG. 6, a lower attaching boss 28*b* which makes the block assembling bolt 24 extend through the lower block portion 6*b* is formed so that its lower opening is provided within the lower block portion 6*b* or the oil pan 37. This returns the oil which has invaded a hole of the lower attaching boss 28*b*, from the lower opening into the oil pan 37 and therefore does not leak it out of the engine. Further, when sealing the butting surfaces of the upper and lower block portions 6*a* and 6*b*, there is a case where adhesive is applied to the butting surfaces. However, even if the oil has invaded the hole of the lower assembling boss 28*b*, it does not leak out of the engine. This dispense with the necessity of applying the adhesive to whole the surrounding of an upper opening of the lower assembling boss 28*b*. Consequently, it does not take much labor to seal the butting surfaces of the upper and lower block portions.

An oil level gauge 31 is attached in the following manner.

As shown in FIGS. 5 and 6, a concaved space 30 opposes to the inner side wall portion 27 from the latter's external side. Arranged in the concaved space 30 is a boss 32 for inserting the oil level gauge 31. This can reduce the width of the cylinder block 6. Further, the boss 32 is arranged laterally of the bearing wall 10 of the crank shaft 5. This makes it possible to insert the oil level gauge 31 into a mid portion of the oil pan 37 in the left and right direction while avoiding the rotating crank arm 26 and connecting rod 25, which results in being able to precisely detect the oil level even if the engine is inclined in the left and right direction.

As shown in FIG. 5, there are arranged undrilled wall portions 33 for forming the bosses 32 into which the oil level gauges 31 are inserted, within the concaved spaces 30 at a plurality of portions of the left and right outer walls 14. This makes it possible to select the position for attaching the oil level gauge 31 and besides enhance the rigidity of the cylinder block 6.

The other structures for strengthening the rigidity of the cylinder block 6 are as follows.

Figure 3:
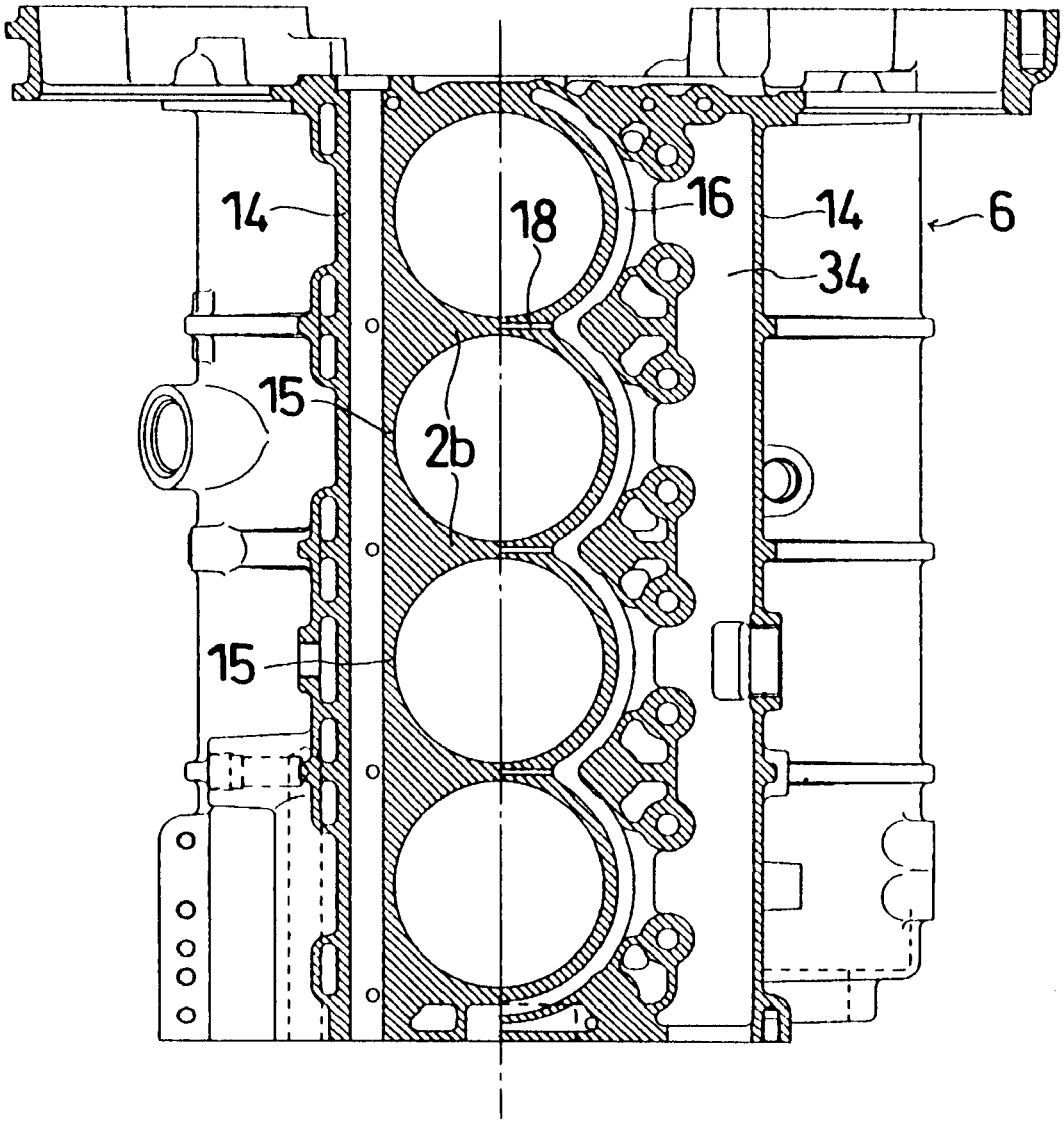
FIG. 3 is a sectional view of FIG. 1 taken along a line III—III.

As shown in FIG. 3, a side water passage 34 is provided in one of the left and right outer walls 14 of the cylinder block 6 so as to run in the front and rear direction. A water jacket 16 is provided within the cylinder block 6. In order to introduce cooling water from a radiator to the water jacket 16 through the side water passage 34, as shown in FIG. 6, the cylinder block 6 has one of its outer walls 14 partly and outwardly curved for providing a projection. The side water passage 34 is formed inside the projection. When providing balancer shaft accommodating chambers 35, 36 in both of the left and right outer walls 14 of the cylinder block 6 so that they run in the front and rear direction, the outer walls 14 of the cylinder block 6 are partly and outwardly curved for providing projections. The balancer shaft accommodating chambers 35 and 36 are formed inside the projections. The balancer accommodating chambers 35, 36 accommodate secondary balancer shafts 38, 39.

What is claimed is:

1. A multi-cylinder engine comprising adjacent cylinder walls (1),(1) mutually connected to form an inter-cylinder wall (2), when assuming a direction of a cylinder center axis (3) as a vertical direction, a side on which a cylinder head is situated as an upper side, a width direction of a cylinder block (6) as a left and right direction, and a spanning direction of a crank shaft (5) as a front and rear direction, the inter-cylinder wall (2) having an upper side portion **(2*a*) provided on its left and right both sides with inter-cylinder bosses (7),(7), the inter-cylinder bosses (7),(7) being connected to left and right both sides (2*c*),(2*c*) of a lower side portion (2*b*) of the inter-cylinder wall (2) in continuity therewith, a head bolt (8) extending through the cylinder head (4) and being inserted into one of the inter-cylinder bosses (7),(7), an upper female screw (9) being provided in one or both of the inter-cylinder boss (7) and the lower side portion (2*b*) of the inter-cylinder wall (2), the head bolt (8) engaging with the upper female screw (9) in screw-thread attachment so as to assemble the cylinder head (4) to the cylinder block (7), the cylinder block (6) having a crank case within which a bearing wall (10) of the crank shaft (5) is formed, the being wall (10) being divisible into an upper wall portion (10*a*) and a lower wall portion (lob), the upper wall portion (10*a*) being connected to the cylinder block (6) and being provided on its left and right both side with upper wall bosses (11),(11) which are connected to the left and right both sides (2*c*),(2*c*) of the lower side portion (2*b*) of the inter-cylinder wall (2) in continuity therewith a bearing bolt (12) extending through the lower wall portion (10*b*) and being inserted into one of the upper wall bosses (11),(11), a lower female screw (13) being provided in one or both of the upper wall boss (11) and the lower side portion (2*b*) of the inter-cylinder wall (2), the bearing bolt (12) engaging with the lower female screw (13) in screw-thread attachment so as to assemble the lower wall portion (10*b*) to the cylinder block (6), wherein an inner space (17) is interposed between the upper and lower female screws (9),(13) and an outer wall (14) of the cylinder block (6), the cylinder wall (1) has lower peripheral left and right wall portions (15),(15) connected to the left and right both sides (2*c*),(2*c*) of the lower side portion (2*b*) of the inter-cylinder wall (2) in continuity therewith in the front and rear direction, the lower left and right peripheral wall portions (15),(15) of the cylinder wall (1) increasing their thicknesses progressively as they approach the left and right both sides (2*c*),(2*c*) and a transverse water passage (18) is formed in the inter-cylinder wall (2) so that its lowermost edge (20) is arranged higher than a position (19)** of a piston ring at the uppermost portion of a piston head positioned at a bottom dead center.

2. A multi-cylinder engine comprising adjacent cylinder walls (1),(1) mutually connected to form an inter-cylinder wall (2), when assuming a direction of a cylinder center axis (3) as a vertical direction, a side on which a cylinder head is situated as an upper side, a width direction of a cylinder block (6) as a left and right direction, and a spanning direction of a crank shaft (5) as a front and rear direction, the inter-cylinder wall (2) having an upper side portion **(2*a*) provided on its left and right both sides with inter-cylinder bosses (7),(7), the inter-cylinder bosses (7),(7) being connected to left and right both sides (2*c*),(2*c*) of a lower side portion (2*b*) of the inter-cylinder wall (2) in continuity therewith, a head bolt (8) extending through the cylinder head (4) and being inserted into one of the inter-cylinder bosses (7),(7), an upper female screw (9) being provided in one or both of the inter-cylinder boss (7) and the lower side portion (2*b*) of the inter-cylinder wall (2), the head bolt (8) engaging with the upper female screw (9) in screw-thread attachment so as to assemble the cylinder head (4) to the cylinder block (6), the cylinder block (6) having a crank case within which a bearing wall (10) of the crank shaft (5) is formed, the bearing wall (10) being divisible into an upper wall portion (10*a*) and a lower wall portion (10*b*), the upper wall portion (10*a*) being connected to the cylinder block (6) and being provided on its left and right both side with upper wall bosses (11),(11) which are connected to the left and right both sides (2*c*),(2*c*) of the lower side portion (2*b*) of the inter-cylinder wall (2) in continuity therewith a bearing bolt (12) extending through the lower wall portion (10*b*) and being inserted into one of the upper wall bosses (11),(11), a lower female screw (13) being provided in one or both of the upper wall boss (11) and the lower side portion (2*b*) of the inter-cylinder wall (2), the bearing bolt (12) engaging with the lower female screw (13) in screw-thread attachment so as to assemble the lower wall portion (10*b*) to the cylinder block (6), wherein an inner space (17) is interposed between the upper and lower female screws (9),(13) and an outer wall (14) of the cylinder block (6), the cylinder wall (1) has lower peripheral left and right wall portions (15),(15) connected to the left and right both sides (2*c*),(2*c*) of the lower side portion (2*b*) of the inter-cylinder wall (2) in continuity therewith in the front and rear direction, the lower left and right peripheral wall portions (15),(15) of the cylinder wall (1) increasing their thicknesses progressively as they approach the left and right both sides (2*c*),(2*c*), and the head bolt (8) and the bearing bolt (12)** are of the same type.

3. A multi-cylinder engine comprising adjacent cylinder walls (1),(1) mutually connected to form an inter-cylinder wall (2), when assuming a direction of a cylinder center axis (3) as a vertical direction, a side on which a cylinder head is situated as an upper side, a width direction of a cylinder block (6) as a left and right direction, and a spanning direction of a crank shaft (5) as a front and rear direction, the inter-cylinder wall (2) having an upper side portion **(2*a*) provided on its left and right both sides with inter-cylinder bosses (7),(7), the inter-cylinder bosses (7),(7) being connected to left and right both sides (2*c*),(2*c*) of a lower side portion (2*b*) of the inter-cylinder wall (2) in continuity therewith, a head bolt (8) extending through the cylinder head (4) and being inserted into one of the inter-cylinder bosses (7),(7), an upper female screw (9) being provided in one or both of the inter-cylinder boss (7) and the lower side portion (2***b*) of the inter-cylinder wall (2), the head bolt (8) engaging with the upper female screw (9) in screw-thread attachment so as to assemble the cylinder head (4) to the cylinder block (6), the cylinder block (6) having a crank case within which a bearing wall (10) of the crank shaft (5) is formed, the bearing wall (10) being divisible into an upper wall portion (10*a*) and a lower wall portion (lob), the upper wall portion (10*a*) being connected to the cylinder block (6) and being provided on its left and right both side with upper wall bosses (11),(11) which are connected to the left and right both sides (2*c*),(2*c*) of the lower side portion (2*b*) of the inter-cylinder wall (2) in continuity therewith, a bearing bolt (12) extending through the lower wall portion (10*b*) and being inserted into one of the upper wall bosses (11),(11), a lower female screw (13) being provided in one or both of the upper wall boss (11) and the lower side portion (2*b*) of the inter-cylinder wall (2), the bearing bolt (12) engaging with the lower female screw (13) in screw-thread attachment so as to assemble the lower wall portion (10*b*) to the cylinder block (6), wherein an inner space (17) is interposed between the upper and lower female screws (9),(13) and an outer wall (14) of the cylinder block (6), the cylinder wall (1) has lower peripheral left and right wall portions (15),(15) connected to the left and right both sides (2*c*),(2*c*) of the lower side portion (2*b*) of the inter-cylinder wall (2) in continuity therewith in the front and rear direction, the lower left and right peripheral wall portions (15),(15) of the cylinder wall (1) increasing their thicknesses progressively as they approach the left and right both sides (2*c*),(2*c*), and a hole (23) of an interlocking shaft (22) invades the lower side portion (2*b*) of the inter-cylinder wall (2) between the upper female screw (9) and the lower female screw (13).

4. A multi-cylinder engine comprising adjacent cylinder walls (1), (1) mutually connected to form an inter-cylinder wall (2), when assuming a direction of a cylinder center axis (3) as a vertical direction, a side on which a cylinder head is situated as an upper side, a width direction of a cylinder block (6) as a left and right direction, and a spanning direction of a crank shaft (5) as a front and rear direction, the inter-cylinder wall (2) having an upper side portion (2*a*) provided on its left and right both sides with inter-cylinder bosses (7),(7), the inter-cylinder bosses (7),(7) being connected to left and right both sides (2*c*),(2*c*) of a lower side portion (2*b*) of the inter-cylinder wall (2) in continuity therewith, a head bolt (8) extending through the cylinder head (4) and being inserted into one of the inter-cylinder bosses (7),(7), an upper female screw (9) being provided in one or both of the inter-cylinder boss (7) and the lower side portion (2*b*) of the inter-cylinder wall (2), the head bolt (8) engaging with the upper female screw (9) in screw-thread attachment so as to assemble the cylinder head (4) to the cylinder block (6), the cylinder block (6) having a crank case within which a bearing wall (10) of the crank shaft (5) is formed, the bearing wall (10) being divisible into an upper wall portion (10*a*) and a lower wall portion (10*b*), the upper wall portion (10*a*) being connected to the cylinder block (6) and being provided on its left and right both side with upper wall bosses (11),(11) which are connected to the left and right both sides (2*c*),(2*c*) of the lower side portion (2*b*) of the inter-cylinder wall (2) in continuity therewith, a bearing bolt (12) extending through the lower wall portion (10*b*) and being inserted into one of the upper wall bosses (11),(11), a lower female screw (13) being provided in one or both of the upper wall boss (11) and the lower side portion (2*b*) of the inter-cylinder wall (2), the bearing bolt (12) engaging with the lower female screw (13) in screw-thread attachment so as to assemble the lower wall portion (10*b*) to the cylinder block (6), wherein an inner space (17) is interposed between the upper and lower female screws (9),(13) and an outer wall (14) of the cylinder block (6), the cylinder wall (1) has lower peripheral left and right all portions (15),(15) connected to the left and right both sides (2*c*),(2*c*) of the lower side portion (2*b*) of the inter-cylinder wall (2) in continuity therewith in the front and rear direction, the lower left and right peripheral wall portions (15),(15) of the cylinder wall (1) increasing their thicknesses progressively as they approach the left and right both sides (2*c*),(2*c*), and the cylinder block (6) is divisible from a mid-portion of the crank case into an upper block portion (6*a*) and a lower block portion (6*b*) either of which is provided with an outer wall of the crank case, the lower block portion (6*b*) being assembled to the upper block portion (6*a*) through a block assembling bolt (24).

5. A multi-cylinder engine as set forth in claim 4, wherein the bearing wall (10) has the lower wall portion (10*b*) connected to the lower block portion (6*b*).

6. A multi-cylinder engine comprising adjacent cylinder walls (1),(1) mutually connected to form an inter-cylinder wall (2), when assuming a direction of a cylinder center axis (3) as a vertical direction, a side on which a cylinder head is situated as an upper side, a width direction of a cylinder block (6) as a left and right direction, and a spanning direction of a crank shaft (5) as a front and rear direction, the inter-cylinder wall (2) having an upper side portion (2*a*) provided on its left and right both sides with inter-cylinder bosses (7),(7), the inter-cylinder bosses (7),(7) being connected to left and right both sides (2*c*),(2*c*) of a lower side portion (2*b*) of the inter-cylinder wall (2) in continuity therewith, a head bolt (8) extending through the cylinder head (4) and being inserted into one of the inter-cylinder bosses (7),(7), an upper female screw (9) being provided in one or both of the inter-cylinder boss (7) and the lower side portion (2*b*) of the inter-cylinder wall (2), the head bolt (8) engaging with the upper female screw (9) in screw-thread attachment so as to assemble the cylinder head (4) to the cylinder block (6), the cylinder block (6) having a crank case within which a bearing wall (10) of the crank shaft (5) is formed, the bearing wall (10) being divisible into an upper wall portion (10*a*) and a lower wall portion (10*b*), the upper wall portion (10*a*) being connected to the cylinder block (6) and being provided on its left and right both side with upper wall bosses (11),(l 1) which are connected to the left and right both sides (2*c*),(2*c*) of the lower side portion (2*b*) of the inter-cylinder wall (2) in continuity therewith, a bearing bolt (12) extending through the lower wall portion (10*b*) and being inserted into one of the upper wall bosses (11),(11), a lower female screw (13) being provided in one or both of the upper wall boss (11) and the lower side portion (2*b*) of the inter-cylinder wall (2), the bearing bolt (12) engaging with the lower female screw (13) in screw-thread attachment so as to assemble the lower wall portion (10*b*) to the cylinder block (6), wherein an inner space (17) is interposed between the upper and lower female screws (9),(13) and an outer wall (14) of the cylinder block (6), the cylinder wall (1) has lower peripheral left and right wall portions (15),(15) connected to the left and right both sides (2*c*),(2*c*) of the lower side portion (2*b*) of the inter-cylinder wall (2) in continuity therewith in the front and rear direction, the lower left and right peripheral wall portions (15),(15) of the cylinder wall (1) increasing their thicknesses progressively as they approach the left and right both sides (2*c*),(2*c*), and the cylinder block (6) has left and right outer walls (14),(14) curved along external outlines of a connecting rod (25) and a crank arm (26) which pass the vicinity of the left and right outer walls (14),(14), the left and right outer walls (14),(14) having inner side wall portions (27) which are retreated inwards, attaching bosses (28*a*),(28*b*) of a block assembling bolt (24) being formed in each of the inner side wall portions (27).

* * * * *